US005411180A

United States Patent [19]

Dumelle

[11] Patent Number: 5,411,180

[45] Date of Patent: May 2, 1995

[54] SELF-CONTAINED HYDRAULIC DISPENSING MECHANISM WITH PRESSURE RELIEF REGULATOR

[75] Inventor: John F. Dumelle, Chicago, Ill.

[73] Assignee: Innovative Technology Sales, Inc., Chicago, Ill.

[21] Appl. No.: 60,208

[22] Filed: May 7, 1993

[51] Int. Cl.[6] ..... B67D 5/00

[52] U.S. Cl. ..... 222/137; 222/389

[58] Field of Search ..... 222/258, 261, 326, 327, 222/389, 137; 184/105.2; 239/526, 126; 251/82; 137/522

[56] References Cited

U.S. PATENT DOCUMENTS

| | | | |
|---|---|---|---|
| 2,051,100 | 8/1936 | Nelson | 137/523 |
| 3,651,994 | 3/1972 | Nordenholt | 222/160 |
| 4,342,310 | 8/1982 | Lindmayer et al. | 222/389 X |
| 4,676,410 | 6/1987 | von Flue | 222/389 X |
| 4,854,482 | 8/1989 | Bergner | 222/389 X |
| 4,871,088 | 10/1989 | Cox | 222/326 X |
| 4,934,827 | 6/1990 | Taschke et al. | 222/137 X |
| 5,005,735 | 4/1991 | Keller | 222/137 |
| 5,015,233 | 5/1991 | McGough et al. | 222/389 X |
| 5,020,693 | 6/1991 | Ernst et al. | 222/137 |
| 5,064,098 | 11/1991 | Hutter, III et al. | 222/389 X |
| 5,092,492 | 3/1992 | Centea | 222/137 |
| 5,123,568 | 6/1992 | Keller | 222/389 X |
| 5,203,839 | 4/1993 | Skaggs | 222/137 |
| 5,207,357 | 5/1993 | Aronie et al. | 222/137 X |
| 5,224,628 | 7/1993 | Keller | 222/327 X |

FOREIGN PATENT DOCUMENTS

| | | | |
|---|---|---|---|
| 3418052 | 12/1984 | Germany | 222/327 |
| 3920694 | 1/1991 | Germany | 222/137 |

*Primary Examiner*—Andres Kashnikow
*Assistant Examiner*—Lesley D. Morris
*Attorney, Agent, or Firm*—Allegretti & Witcoff, Ltd.

[57] ABSTRACT

A self-contained dispensing mechanism includes a main body joined to a reservoir, cylinder and piston structure on the main body and a stop assembly for securing containers on said main body. A pump is provided in the main body for pumping liquid from the reservoir to the cylinder to actuate the piston therein. A piston rod, secured to the piston and movable therewith actuates push rods with push ends for dispensing viscous material from the containers. The push ends are adjustably secured on the push rods for accommodating different sizes of containers.

15 Claims, 3 Drawing Sheets

SELF-CONTAINED HYDRAULIC DISPENSING MECHANISM WITH PRESSURE RELIEF REGULATOR

BACKGROUND OF THE INVENTION

This invention pertains to a portable, self-contained, dispensing mechanism for sealants, caulking, adhesives and other like compounds.

It is known in the art to provide a mechanically actuated device for dispensing sealants, caulking, adhesives and like viscous materials. Such devices are ordinarily actuated by the hand of the operator through a pawl and ratchet mechanism to move a push rod into one end of a container of the viscous material in order to dispense same from a nozzle at the opposite end. Since all of the force must be applied by the hand of the operator, the pressure that can be developed is limited by the strength of the user.

Other known devices for dispensing sealants or other like viscous material are actuated by a pressure medium, such as air or hydraulic fluid. Such devices provide more power for discharging material from a container, but they are relatively expensive and limited in use. They must be connected to a source of the pressure medium by a hose. If the pressure medium is air, the source may be an air compressor. If the pressure medium is hydraulic fluid, the source may be a reservoir. These devices are limited in range of use to the length of hose connecting the air compressor or the other source of pressure medium to the device. An example of a device for dispensing a viscous compound utilizing a pressure medium is shown in the Von Flue U.S. Pat. No. 4,676,410.

Sometimes it is desirable to dispense two components from a dispenser gun. Simultaneous actuation of two cylinders requires considerably more force then a single container dispensing gun. The Huttier U.S. Pat. No. 5,064,098 reveals a dual component dispenser gun that is driven from a remote air source.

The Cox U.S. Pat. No. 4,871,088 discloses a pneumatic dispenser for two part compositions. The prior art Cox device is limited in application in that the hose connection to the source of pressure medium reduces or limits the range of movement and the devices themselves are relatively cumbersome and costly. If the hose is cut or damaged, the pressure medium will leak.

An object of the present invention is to provide a two component dispensing mechanism that is self-contained and portable.

Another object of the present invention is to provide a dispensing mechanism for viscous materials that includes a body containing a liquid reservoir for hydraulic fluid, a cylinder connected to the body containing the reservoir, a piston in the cylinder connected to a piston rod pump means in the block means for pumping liquid from the reservoir into the cylinder for actuating the piston rod in one direction, push rod means connected to the piston rod for movement therewith, and a stop assembly on the body for receiving and retaining a container or containers of viscous material. Other objects and advantages of the present invention will become more apparent hereinafter.

BRIEF DESCRIPTION OF THE DRAWING

There is shown in the attached drawing a presently preferred embodiment of the present invention, wherein like numerals refer to like elements in the various views and wherein.

DETAILED DESCRIPTION OF THE PRESENT INVENTION

Figure 1:
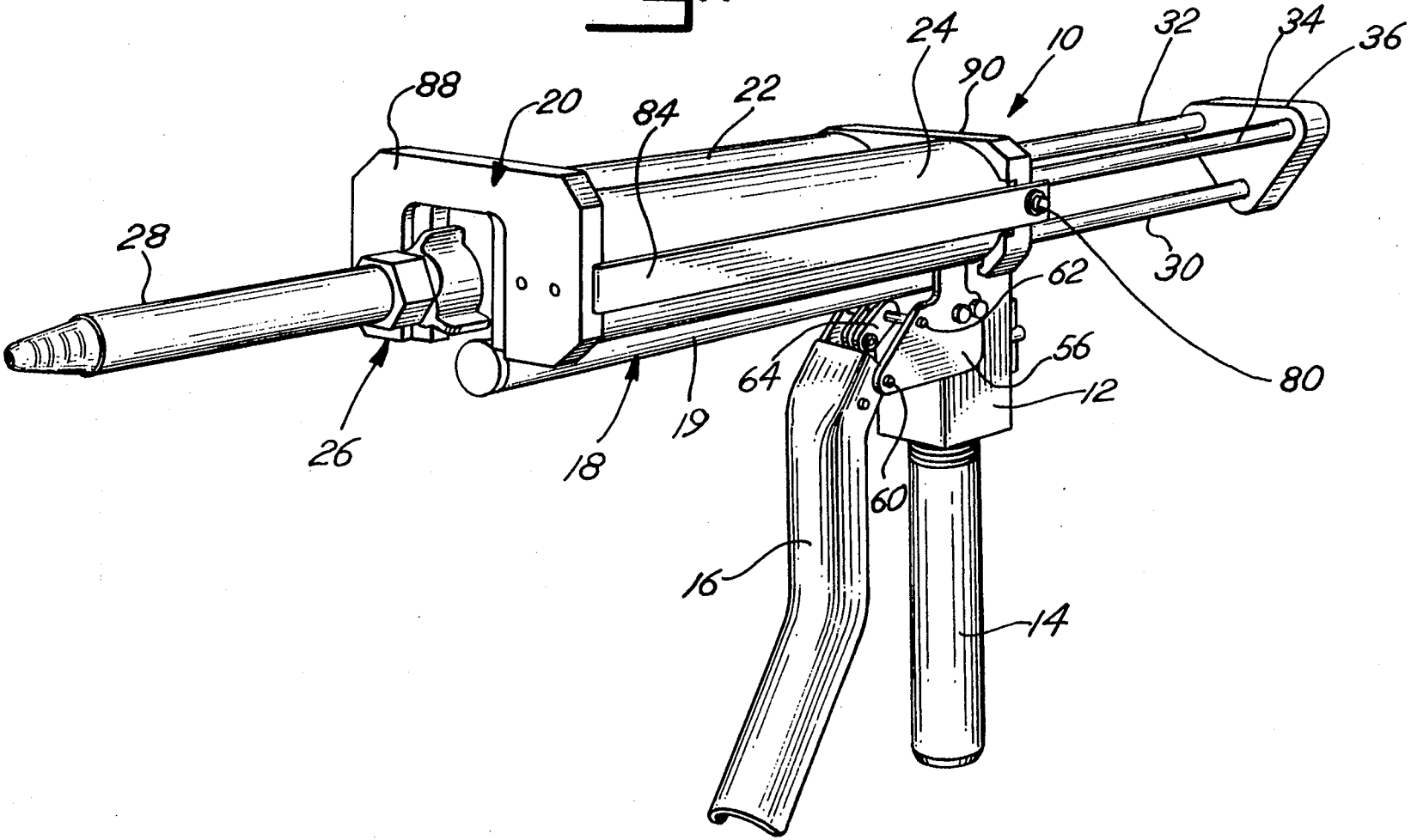
FIG. 1 is a perspective view of a self-contained dispensing mechanism embodying the present invention.

There is shown in FIG. 1 the dispensing mechanism 10 of the present invention. The dispensing mechanism 10 comprises a body or block 12 to which is secured a reservoir 14 for liquid, for example, hydraulic fluid. An actuating handle 16 is pivotally secured on the block 12 for actuating pump means therein, as will be described hereafter. Piston and cylinder means 18 are secured to the body 12 and are operatively connected to the reservoir 14. A stop assembly 20 is pivotally secured on the body 12 for receiving and retaining containers 22 and 24, which contain the viscous material to be discharged. The viscous material may be for example caulking or a two part adhesive that is mixed prior to discharge from a common nozzle. A nozzle assembly 26 is secured to the forward end of the containers 22 and 24 for receiving material therefrom, and discharging same through the single nozzle 28. The piston rod 30 of the cylinder and piston means 18 is adapted to be connected to the push rods 32 and 34 by means of the push block 36 in order to actuate the push rods 32 and 34 to discharge material from the containers 22 and 24.

Referring now to FIGS. 2–6 there is better shown the details of the dispensing mechanism 10. Provided within the reservoir 14 is a piston 40 that is adapted to be moved upwardly by a spring 42 for urging fluid in the reservoir 14 upwardly as viewed in FIG. 2. Fluid is confined in the reservoir 14 above the piston 40.

Within the body 12 is a transverse passage 44 adapted to receive a pump means 46 comprising a piston 70 that is actuated by the handle 16 in order to draw fluid through a one way check valve 49 and passage 47 from the reservoir 14 to the passage 44 and to force fluid through passage 44 to the cylinder 19 of the cylinder and piston assembly 18 via passage 48 in order to actuate the piston rod 30. The passage 47 may be considered a first passage and the passage 48 may be considered a second passage. When the pump means 46 is reciprocated within the passage 44 in the block 12, fluid will be drawn from the reservoir 14 through valve 49 and passage 47 on the forward stroke of the piston 70. When the handle 16 is squeezed, the piston 70 is moved rearwardly, the check valve 49 is closed and fluid is forced from passage 44 through the passage 48 to the cylinder 19 in order to force the piston and piston rod 30 carried therewith to the right as viewed in FIG. 2 in order to move the push block 36 and the push rods 32 and 34 to the right and thereby force the viscous material from the cylinders 22 and 24. Instantaneous pressure release is provided by rotating valve 50 to open the passage 52 in order to permit the fluid to bleed back to the reservoir 14 when the containers 22, 24 are empty so as to permit withdrawal of the push rods 32, 34 from the containers 22, 24 and to initiate a new actuating cycle. The passage 52 may be considered to be a third passage in the body 12.

The handle 16 is pivotally secured to the brackets 56 and 58 by means of the pin 60. Pin 62 which connects between the brackets 56 and 58 provides a pivot for links 63, 64. The links 63, 64 are in turn pivotally secured to the link 66 by means of a pin 68. The link 66 is secured to the piston 70 by means of a pin 72. Pivotally secured on the handle pin 74 that extends between the brackets 56 and 58 is a link 76 that is in turn pivoted to the link 66 by pin 77. A torsion spring 78 operates between pin 62 and the handle 16 for urging the handle 16 to the right (or counterclockwise) as viewed in FIG. 2.

Figure 5:
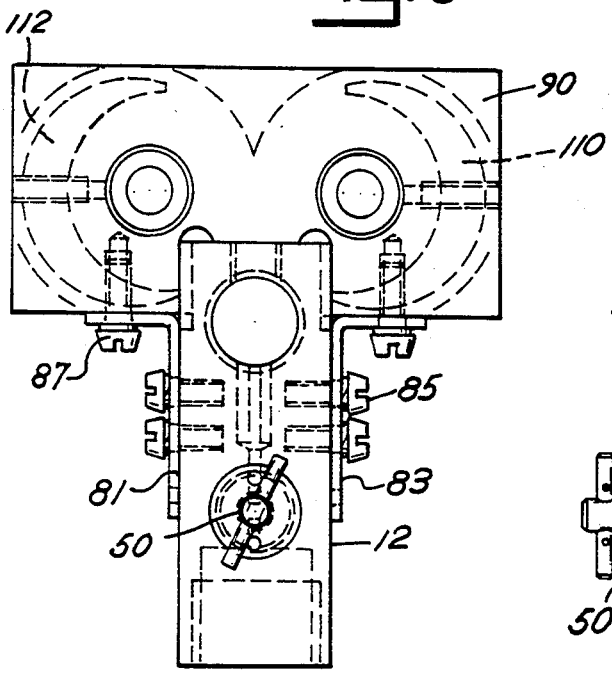
FIG. 5 is an enlarged rear detail view of the self-contained dispensing mechanism.
Figure 6:
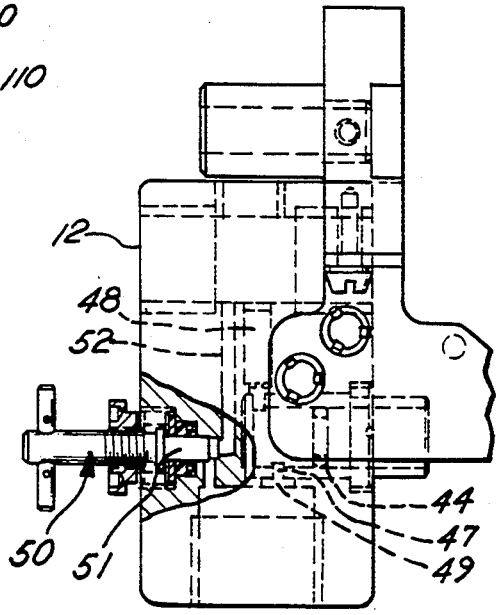
FIG. 6 is an enlarged detail view taken at 90° with respect to FIG. 5.

The tube stop 90 is secured to the main body or block 12 by means of brackets 81 and 83. The brackets 81 and 83 are secured to the body 12 by suitable fasteners, e.g., bolts or screws 85 and to the tube stop 90 by suitable fasteners, e.g., bolts or screws 87 (FIG. 5). The tube stop 90 provides a sliding bearing for the push rods 32 and 34. The brackets 81 and 83 and tube stop 90 cooperate to fix the cylinder 19 to the main body 12.

Figures 2, 3, 7:
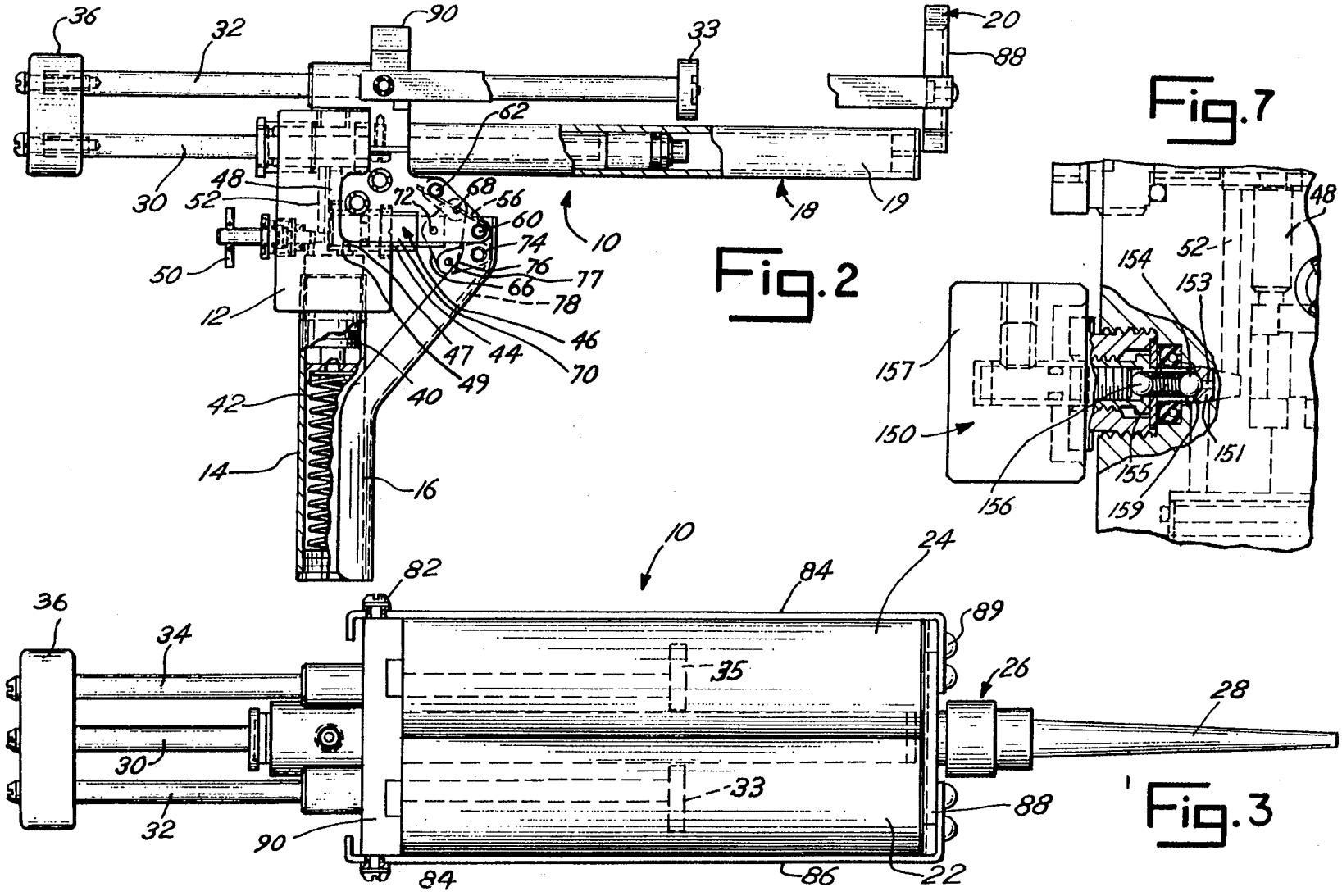
FIG. 2 is a side elevation view, with parts broken away to better show internal components.
FIG. 3 is a plan view of the self-contained dispensing mechanism.
FIG. 7 is an enlarged detail view of a modified pressure regulator assembly.

In use, the handle 16 will be urged counterclockwise by the torsion spring 78 (FIG. 2). As the handle 16 pivots counterclockwise, the piston 70 will be moved to the right as viewed in FIG. 2. Liquid will be drawn into passage 44 through check valve 49 and passage 47. The handle 16 may be squeezed inwardly in opposition to spring 78. Via the linkage connection to handle 16, the piston 70 will be moved inwardly or to the left as viewed in FIG. 2 to force fluid through passage 48 into the cylinder 19 to actuate the piston and rod 30 attached thereto. It will be seen that the piston 70 may be reciprocated in the passage 44 in block 12 in response to actuation of the handle 16. When the valve 50 closes the passage 52, fluid will be drawn from the reservoir 14 by the pump means 46 and forced into the cylinder 19 for actuating the piston rod 30, which in turn will actuate the push rods 32 and 34 to force viscous material from the associated containers.

Figure 4:
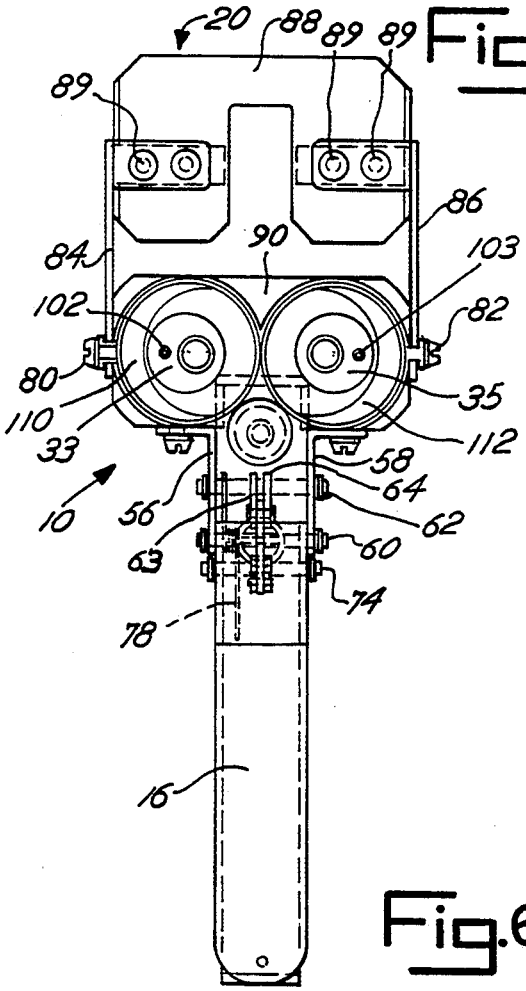
FIG. 4 is a front view of the self-contained dispensing mechanism.

In order to place new cylinders 22 and 24 onto the dispensing mechanism 10 in the first instance or to replace spent containers, the stop assembly 20 is pivoted about the pins 80 and 82. The stop assembly 20 includes the arms 84 and 86 that are secured to the front block or base 88 via fasteners, e.g., screws 89. The front block 88 is generally U-shaped, as seen in FIGS. 1 and 4, and is adapted to engage the front ends of the cylinders 22, 24. The nozzle assembly 26 extends through the space between the sides and the base of the U-shaped front block 88. The stop assembly 20 may be pivoted about the pivot pins 80 and 82 in order to permit removal and replacement of the cylinders 22 and 24. When the cylinder 22 and 24 are properly positioned, such that the rear end of each cylinder engages the tube stop 90, the stop assembly 20 will be positioned so that the member 88 is engaging the front end of the cylinders 22, 24 as shown in FIGS. 1 and 3. Crescent-shaped guides 110 and 112 on the tube stop 90 help position the tubes or containers 22 and 24 properly in the dispensing mechanism 10. The cylinders 22, 24 are disposed substantially parallel to the path of movement of the piston rod 30 and the push rods 32 and 34. Thus, when the push rods 32 and 34 are actuated, the push pads 33 and 35 connected to the push rods 32 and 34 respectively will enter the rear of the cylinders 22 and 24 and push the viscous material forwardly or to the right as viewed, for example, in FIG. 3 for discharge from the nozzle assembly 26.

In FIG. 7 there is illustrated a modified pressure regulator assembly. The on-off valve 50 is replaced by a pressure relief regulator assembly 150 that includes a valve stem 151 for closing passage 52. Stem 151 has a passage 153 therein closed by a ball 154. The ball 154 is urged by a spring 155 to a position closing passage 153. If the pressure in passage 153 acting against the ball 154 exceeds a predetermined value, the ball 154 will move to the left as viewed in FIG. 7, permitting fluid to flow from passage 52 into passage 153 and through passage 159 for return to the reservoir 14. Handle 157 can be rotated to move the stem 153 between a position opening passage 52 and a position closing passage 52. Basically, the regulator assembly 150 functions in a fashion similar to the valve 50, and performs the additional function of pressure relief in passage 52. Spring 155 may be adjusted for different release pressure levels by rotation of handle 157 or different springs may be used to obtain different predetermined pressure relief levels to permit fluid to bleed back to reservoir 14 when a predetermined pressure is attained in cylinder 19 and passage 52.

Figure 8:
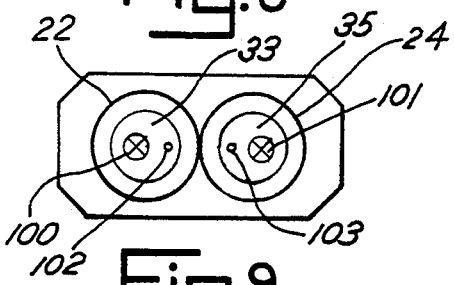
FIG. 8 is a detail view of the push pads of the self-contained dispensing mechanism, illustrating the position of the push pads for operating smaller size tubes of adhesive or like material.
Figure 9:
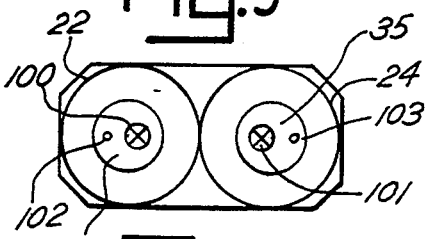
FIG. 9 is a detail view of the push pads similar to FIG. 8, but illustrating the position of the push pads for operating two larger size tubes.
Figure 10:
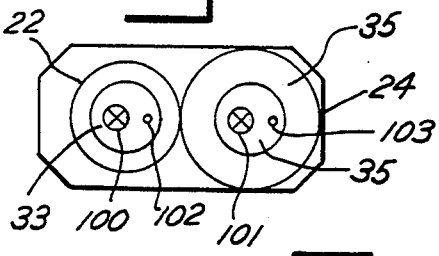
FIG. 10 is a detail view of the push pads similar to FIG. 8, but illustrating the position of the push rods for operating one smaller size tube and one larger size tube.

Turning now to FIGS. 8, 9 and 10 there is shown the novel adjustment means of the present invention for permitting adjustment of the push ends 33 and 35 to accommodate different sizes of containers. For example, the present invention may be utilized with either 150 ml tubes or containers of viscous material or 300 ml tubes or containers of viscous material. That is, there might be two tubes of each size or one tube of 150 ml and one tube of 300 ml. In order to properly force the material from the tubes, the push pads 33 and 35 are adapted to be adjusted with respect to the push rods 32 and 34. In FIG. 8 there is shown the position of the push pads 33 and 35 to accommodate two 150 ml tubes. The adjustment screws 100 and 101 respectively are loosened in order to position the identification marks 102 and 103 as shown in FIG. 8. Then the screws 100 and 101 are tightened to fix the push pads in the adjusted position shown.

Turning to FIG. 9, there is shown the position of the push ends 33 and 35 for accommodating two 300 ml tubes. To accomplish the adjustment, the adjustment screws 100 and 101 are loosened and the push ends 33 and 35 are rotated until the identification marks 102 and 103 are positioned as shown in FIG. 9. Then the adjustment screws 100 and 101 are tightened to fix the push pads 33 and 35 in the desired position.

Turning to FIG. 10, there is illustrated the example of a combination of tubes, one 150 ml and one 300 ml. In this case, the adjustments screws 100 and 101 are loosened in order to position the push ends 33 and 35 as shown with the identification marks 102, 103 positioned as shown. Push pad 33 is positioned as previously shown in FIG. 8, while push pad 35 is positioned as previously shown in FIG. 9. The adjustment screws 100 and 101 are tightened to hold the push pads 33 and 35 in their predetermined adjusted positions. The adjustment means permit the push pads to be oriented concentric with the axis of each of the tubes 22 and 24, regardless of the size of the tubes or containers that are employed in the dispensing mechanism.

In order to utilize the dispensing mechanism 10, the valve or pressure relief valve 50 is rotated counterclockwise in order to open the passage 52. The push block 36 is pulled to the left or rearwardly as viewed in FIG. 2 until the push pads 33 and 35 engage against the plate or tube stop 90. The pressure relief valve or valve 50 is then rotated clockwise until it closes the passage 52. The containers 22 and 24 are positioned with their rear ends against the tube stop or plate 90 and they are disposed generally parallel to the axis of the push rods 32. The stop assembly 20 is then pivoted to the position shown in FIGS. 1 and 2, with the block 88 engaging the front end of the tubes or containers 22 and 24 respectively. Upon actuation of the handle 16, the pump means 46 will be actuated in order to move the piston rod 30 forwardly, thereby urging the push rods 32 and 34 forwardly and dispensing the material from the containers 22 and 24 as needed.

The tubes or containers may be unitary, with a dividing wall defining two chambers therewithin. Preferably the containers comprise separate cylindrical members, each having an opening at one end defined in a projection. The projections are hemispherical in crosssection and complementary one to the other. The flat surfaces of the projections abut one another and the projections are adapted to be connected to one another by an adapter cap that has internal threads adapted to engage with external threads on the projections. A nozzle is secured to the adapter cap so that the viscous material discharged from each container may mix together in the adapter cap and be discharged from the nozzle in a single stream.

As an alternative, the containers might comprise aluminum or like rigid cylinders adapted to receive a foil or thin walled aluminum bag containing viscous material to be dispensed. The viscous material is discharged by collapsing the foil or aluminum bag. After the bags are emptied, the push rods are withdrawn, the bags are removed and fresh bags are inserted into the cylinders. For this application the cylinders are suitably secured to the main block and the stop assembly or swing bracket may be omitted.

While dual or multiple container dispensing of materials is preferred, it will be understood that the invention can be adapted for single container dispensing of a single material.

There has been provided by the present invention a dispensing mechanism for accurately and evenly dispensing viscous material. Sufficient power is developed by the pump means, up to 5000 psi, to accommodate larger volume of material and more viscous materials. The flow rate can be determined by the size of the opening selected in the mixer tube of the nozzle assembly and the viscosity of the material being dispensed. The dispensing mechanism is portable and self-contained, hence, there is no requirement for expensive air compressors or the attachment to same to a source of hydraulic power. The containers or cartridges of viscous material may be easily installed and removed from the dispensing mechanism.

While I have shown a presently preferred embodiment of the invention, it will be understood to persons skilled in the art that it may be otherwise embodied within the scope of the following claims.

I claim:

1. A self-contained dispensing mechanism for a viscous material comprising body means including a reservoir for liquid, piston and cylinder means connected to said body means and operatively connected to said reservoir, said piston and cylinder means including a cylinder affixed to the body means and a piston movable in said cylinder, a piston rod secured to said piston, pump means in said body means for pumping liquid from said reservoir into said cylinder for actuating said piston in one direction, push rod means connected to said piston rod for movement therewith, and a stop assembly on said body means for receiving and retaining at least one container of viscous material, said push rod means aligned with said container and movable substantially along the axis of said container, said push rod means including a push end adapted to engage within and move within said container to force viscous material from an exit end thereof said pump means comprising a piston slidable in a chamber in said body means, handle means pivoted on said body means for actuating the piston slidable in said body means, link means between the handle means and the piston, spring means for biasing the handle means to a first position, the handle means being manually actuatable between said first position and a second position for actuating the piston to pump liquid.

2. A dispensing mechanism as in claim 1 wherein the stop assembly comprises a u-shaped member having a base and two arms extending from said base, the free ends of the arms being pivotally secured to the body means, the base being adapted to engage the discharge end of the container for holding the container in position on the dispensing mechanism.

3. A dispensing mechanism as in claim 1 wherein the stop assembly is constructed and arranged to receive and retain two containers of viscous material arranged in side by side relationship and the push rod means comprises a pair of push rods, each having a push end, one push rod adapted to cooperate with one container for forcing material therefrom and the other push rod adapted to cooperate with the other container for forcing material therefrom.

4. A dispensing mechanism as in claim 1 including first passage means in the body means communicating the reservoir and the chamber, and second passage means in the body means communicating the chamber and the cylinder at one side of the piston therein.

5. A dispensing mechanism as in claim 6 including a third passage means communicating the cylinder and the reservoir, and pressure relief means in the third passage means for permitting liquid in the cylinder to return to the reservoir when a predetermined pressure is attained in the cylinder and third passage means.

6. A dispensing mechanism as in claim 5 wherein the pressure relief means is adjustable to obtain different predetermined pressure relief levels.

7. A dispensing mechanism as in claim 6 wherein the pressure relief means include a valve stem for closing the third passage means, a passage in said valve stem, a ball closing said passage, a spring urging the ball to a position closing the passage, said spring being adjustable for different pressure release levels.

8. A dispensing mechanism as in claim 7 wherein the passage in the valve stem communicates with said third passage means and with said reservoir.

9. A dispensing mechanism as in claim 4 including a third passage means communicating the cylinder with the reservoir, and valve means for selectively opening and closing the third passage means, whereby when the third passage means is closed by the valve means, actuation of the pump means will draw liquid from the reservoir and force it into the cylinder to actuate the piston rod and push rod means secured thereto to force viscous material from the containers, and when the containers are empty, the third passage means is opened by the valve means, liquid can be returned to the reservoir and the push rod means and piston rod may be moved in the opposite direction to enable the components to be returned to their initial position for removal of the spent containers and replacement by new containers.

10. A dispensing mechanism as in claim 1, wherein said handle means includes a handle pivoted on the body means and said link means include a first link pivotally connected to the body means, a second link pivotally connected to the piston and to the first link, and a third link pivotally connected to the second link and to the handle.

11. A self-contained dispensing mechanism for a viscous material comprising body means including a reservoir for liquid, piston and cylinder means connected to said body means and operatively connected to said reservoir, said piston and cylinder means including a cylinder affixed to the body means and a piston movable in said cylinder, a piston rod secured to said piston, pump means in said body means for pumping liquid from said reservoir into said cylinder for actuating said piston in one direction, push rod means connected to said piston rod for movement therewith, and stop assembly on said body means for receiving and retaining at least one container of viscous material, said push rod means aligned with said container and movable substantially along the axis of said container, said push rod means including a push end adapted to engage within and move within said container to force viscous material from an exit end thereof, the stop assembly being constructed and arranged to receive and retain two containers of viscous material arranged in side by side relationship and the push rod means comprises a pair of push rods, each having a push end, one push rod adapted to cooperate with one container for forcing material therefrom and the other push rod adapted to cooperate with the other container for forcing material therefrom including adjustment means for adjustably securing the push end on a push rod, whereby each push end may be adjusted to accommodate different size containers.

12. A dispensing mechanism as in claim 11 wherein the containers contain 300 ml of material.

13. A dispensing mechanism as in claim 11 wherein the containers contain 150 ml of material.

14. A dispensing mechanism as in claim 11 wherein one container contains 300 ml and the second container contains 150 ml.

15. A dispensing mechanism as in claim 11 wherein the adjustment means comprise a screw for rotatably securing a push end on a push rod.

* * * * *